United States Patent [19]

Saloom

[11] 4,102,173

[45] Jul. 25, 1978

[54] END FORMING APPARATUS FOR ELONGATED WORK PIECES

[75] Inventor: Joseph T. Saloom, Youngstown, Ohio

[73] Assignee: Wheatland Tube Company, Philadelphia, Pa.

[21] Appl. No.: 782,766

[22] Filed: Mar. 30, 1977

[51] Int. Cl.[2] ..... B21D 19/08

[52] U.S. Cl. ..... 72/306; 72/312; 72/404; 72/421

[58] Field of Search ..... 72/305, 306, 316, 367, 72/370, 404, 419, 420, 426, 427, 312, 421; 214/1 P, 1 PB

[56] References Cited

U.S. PATENT DOCUMENTS

| | | | |
|---|---|---|---|
| 957,464 | 5/1910 | Horton | 72/286 |
| 2,301,674 | 11/1942 | Andrews, Jr. | 214/1 PB |
| 2,585,459 | 2/1952 | Hahn et al. | 72/306 |
| 3,067,800 | 12/1962 | Gogan | 214/1 PB |
| 3,108,699 | 10/1963 | Anschutz | 214/1 P |
| 3,225,581 | 12/1965 | Hinderer | 72/370 |
| 3,786,666 | 1/1974 | York, Jr. | 72/305 |
| 3,848,453 | 11/1974 | Hardt | 72/467 |
| 3,852,015 | 12/1974 | Stansbury | 425/392 |

*Primary Examiner*—Michael J. Keenan
*Attorney, Agent, or Firm*—Maky, Renner, Otto & Boisselle

[57] ABSTRACT

A high speed end forming apparatus for elongated work pieces, such as coated tube, includes two selectively variably spaced C-shape heads having feed openings therein to receive the two ends of the advancing work piece, the two ends sequentially being clamped and formed in such position, respectively, by relatively movable chuck jaws and forming apparatus carried by such C-shape heads. The work piece is advanced to the C-shape heads by a walking beam transfer conveyor that is simultaneously operative to deliver an unformed work piece to the C-shape heads and to remove a formed work piece from the C-shape heads.

12 Claims, 7 Drawing Figures

END FORMING APPARATUS FOR ELONGATED WORK PIECES

BACKGROUND AND SUMMARY OF THE INVENTION

The present invention relates as indicated to end forming apparatus for elongated work pieces in general and to swaging and dedimpling heads for forming the ends of exteriorly coated elongated tube in particular.

Continuous tube forming and galvanizing process lines are well known in the art as shown, for example, by U.S. Pat. Nos. 3,122,114 and 3,845,540. Such process lines operate at speeds from 50 to 400 feet per minute rapidly to produce the galvanized tube or pipe product. Such galvanized tube may be interiorly and exteriorly coated either on the line as shown in U.S. Pat. Nos. 3,559,280; 3,616,983 and 3,768,145 or off the line after cut-off.

The cut lengths of such coated or uncoated galvanized tube may then require additional processing steps before the end product is ready for shipment. For example, the respective ends of the tube may require swaging and dedimpling depending upon the end use for the same.

In order effectively to use the continuous tube forming and galvanizing line, such subsequently performed operations should be accomplished at a speed generally compatible to the speed of the line so that the product may move in a relatively continuous flow path through the plant. However, applicant is unaware of any commercially available end forming apparatus capable of operating at the necessary speeds.

Accordingly, it is the primary object of the present invention to provide an end forming apparatus capable of operating at high speeds in a relatively continuous feeding and unloading operation. To satisfy such object, the end forming apparatus of the present invention may operate in the range of 15 to 18 finished parts per minute.

It is another object of the present invention to provide a high speed end forming apparatus capable of handling tubes of varying lengths in the same over-all process line. This adaptability permits the tube product to be manufactured to the requested length without special procedures requiring discontinuous operation.

It is yet another object of the present invention to provide end forming apparatus that accurately and dependably swages and dedimples the respective ends of the tube. The interrelationship of the feed, alignment, and forming procedures employed and the dies used therefor permit the tube accurately to be formed with reduced imperfections and/or scrap pieces.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DESCRIPTION OF THE DRAWINGS

In the annexed drawings

FIG. 2A is a fragmentary cross section taken along the plane 2A—2A in FIG. 1 showing the details of the tube separator assembly;

FIG. 3 is a cross-section generally taken along the line 3—3 in FIG. 1 showing the details of the walking beam transfer conveyor for tube feeding and unloading, with the operational cycle of such conveyor being indicated by phantom lines and arrows;

FIG. 6 is a fragmentary elevation of the dedimpling head taken generally along the line 6—6 in FIG. 2, with parts thereof being broken away to illustrate the dedimpling die and the position adjustment mechanism for the dedimpling head.

DETAILED DESCRIPTION OF THE PREFERRED EMBODIMENT

Figure 2:
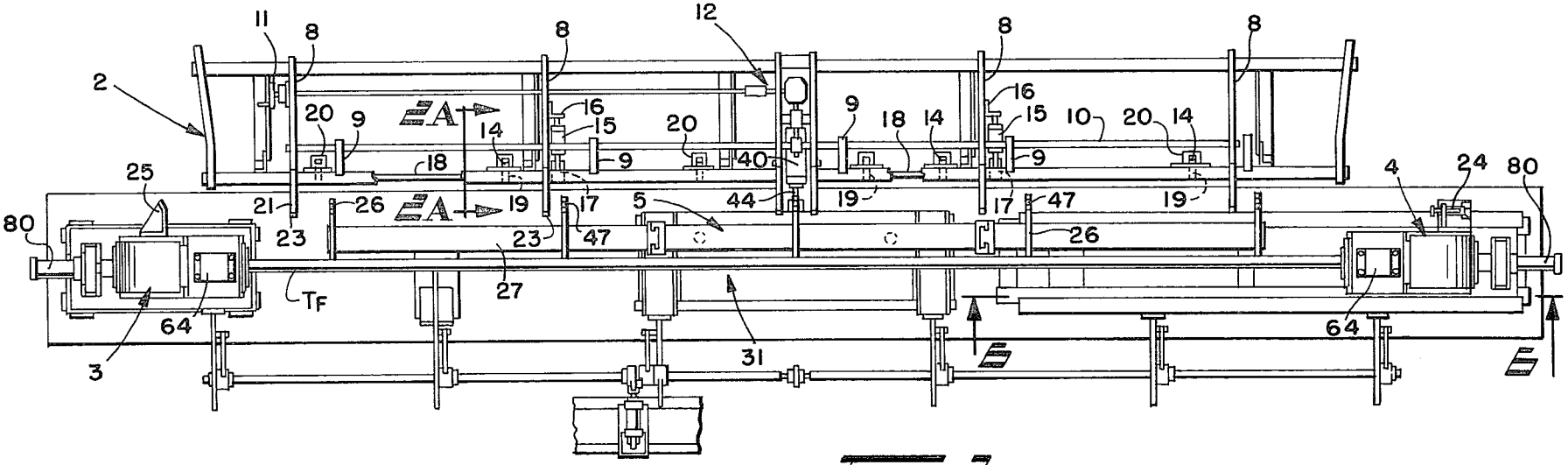
FIG. 2 is a plan view of the end forming apparatus of the present invention taken generally along line 2—2 in FIG. 1 with the tubes being removed for clarity of illustration.
Figure 1:
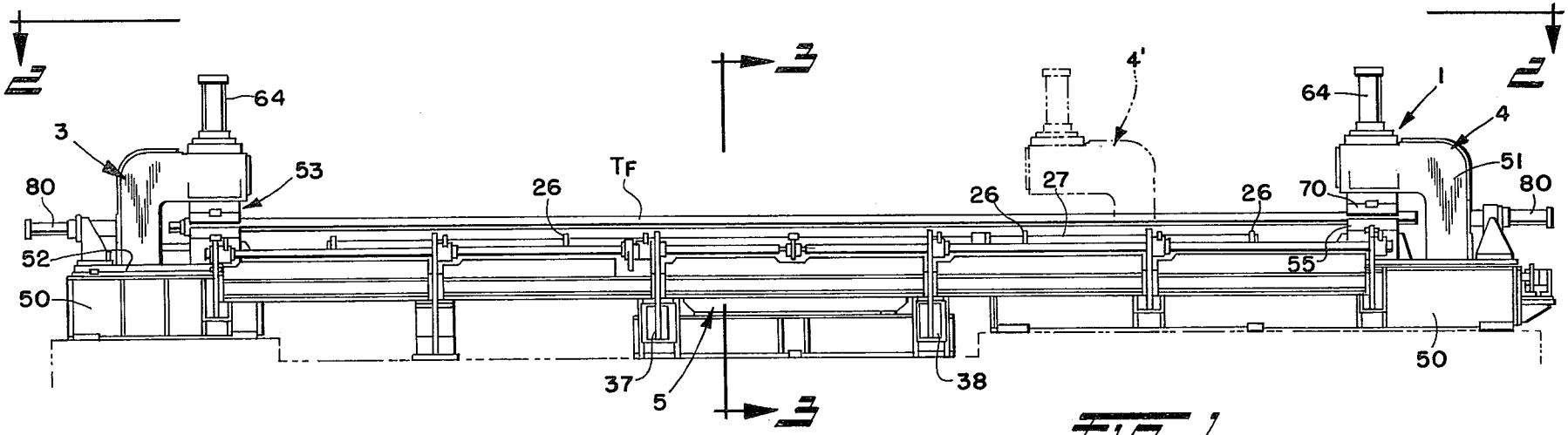
FIG. 1 is a front elevation taken from the downstream side showing the end forming apparatus of the present invention with the variable positioning of one of the forming heads being indicated in phantom lines.
Figures 5A, 5B, 5C:
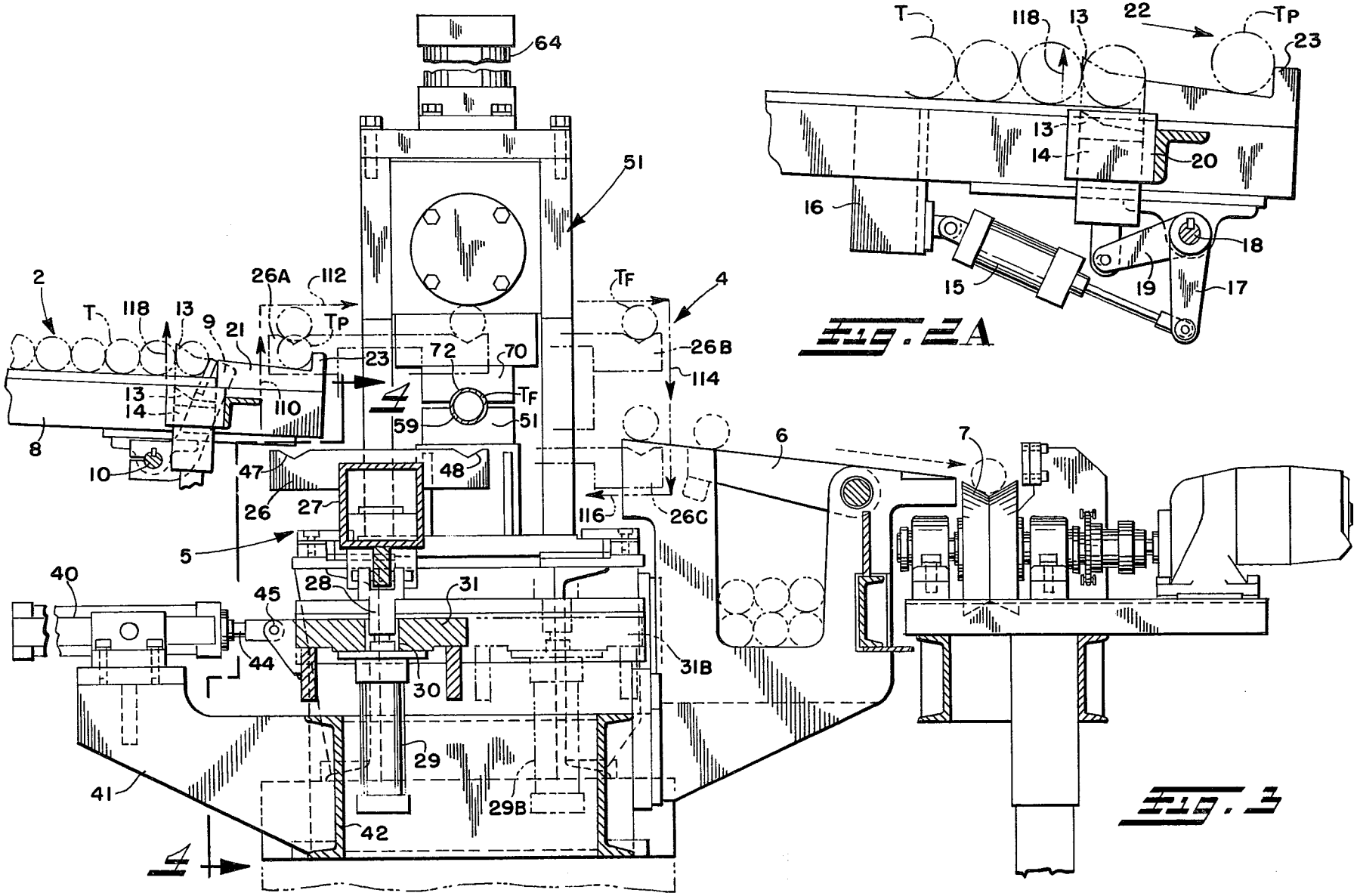
FIG. 5 is a fragmentary elevation of the swaging head taken generally along line 5—5 in FIG. 2, with the swaging die being shown in cross-section to illustrate the construction and operation thereof.

Referring now in more detail to the drawings and initially to FIGS. 1-3, the continuously formed galvanized tubes, which have been cut to length and exteriorly coated with a paint or plastic, are advanced toward and aligned with the end forming apparatus, indicated generally at 1, by a tube delivery and alignment assembly indicated generally at 2. The tubes as thus delivered and aligned are fed to the two transversely spaced C-shape heads 3 and 4 of the end forming apparatus 1 by a walking beam type transfer conveyor, indicated generally at 5. Such walking beam type transfer conveyor 5 has a cycle operative to remove the finished end formed tube from the C-shape heads while conveying the next tube into position. As shown in FIG. 3, such removed finished tube is deposited by the walking beam transfer conveyor on a downwardly inclined ramp assembly 6 leading to a take-off conveyor system 7. The above-mentioned general components of the over-all end forming apparatus and the operation of the same will now be described in detail.

A. The Tube Delivery and Alignment Assembly 2

Referring to FIGS. 1-3, the lengths of galvanized and preferably exteriorly coated tube T have been quenched to remove latent heat from the continuous processing line and are delivered in side to side relationship along downwardly inclined, transversely spaced delivery ramps 8. Although galvanized tube having an exterior coat of paint or plastic applied thereto has been described, the tubes delivered to the end forming apparatus may be totally uncoated and/or coated with any form of desired protective material and still be handled and treated by the end forming apparatus of the present invention. Accordingly, the term "tube" as used herein has a generic definition of an elongated hollow member of any cross section and of one or more layers having any desired diameter, thickness, and length.

As the tubes T roll down the spaced inclined ramps 8 in side to side engagement, the lead tube engages selectively angularly adjustable stops 9. Such stops 9 are keyed to transversely extending, adjustment shaft 10 which is selectively angularly turned by hand wheel 11 coupled thereto by rod and miter gear box assembly 12. The stops 9 are angularly adjusted in accordance with the diameter of the tubes being handled so that the stops engage the lead tube when the trailing edge thereof is directly above triangular projections 13 on the back edges of each of the transversely spaced separator arms 14.

As best shown in FIG. 3, the separator arms 14 are simultaneously elevated by a hydraulic piston cylinder assembly to remove the lead tube from the remaining tubes. Such assembly includes two simultaneously actuated piston-cylinders 15 mounted to the feed ramp frame 16, such piston-cylinders being operative angularly to actuate cranks 17 (FIG. 2A) connected to transversely extending shaft 18. A plurality of transversely spaced pivot links 19 are respectively keyed at one end to shaft 18 and are connected at their other end to the bottom of separator arms 14.

When the piston-cylinders 15 are simultaneously actuated for retraction of the piston rods, the shaft 18 and pivot links 19 will rotate in a clockwise direction as viewed in FIG. 2A vertically to elevate separator arms 14 and triangular projections 13 thereon, with such vertical movement being controlled by rectangularly shaped guides 20 carried by the feed ramp frame 16. During such upwardly directed travel, the projections 13 on separator arms 14 move between the lead tube and the next adjacent tube to strip the lead tube from the remaining tubes. Such projections 13 thus insure that only one tube will be picked up at a time by the separator arms 14 and that such picked-up tube will roll downwardly along the elevated similarly downwardly inclined ramp extensions 21 when the separator arms clear the stops 9. The separator arms 14 are then simultaneously cycled vertically downwardly to a position below inclined ramps 8 to permit the tubes T to roll forwardly until the then leading tube engages stops 9.

The separated tube rolls down such elevated downwardly inclined ramp extensions 21 as indicated by arrow 22 until it engages a series of transversely spaced end stops 23. In such position, an alignment piston-cylinder assembly 24, carried by C-shape head 4, is positioned adjacent the end of the separated and advanced tube and in longitudinal alignment therewith, as best shown in FIG. 2. Such piston-cylinder assembly 24 is then actuated to engage the end of such tube and to push the same until the other end thereof abuts gage plate 25 carried by fixed forming head 3. The alignment piston-cylinder assembly is then returned to its unextended deactuated position leaving the tube in the position Tp shown in dotted lines in FIG. 3 for aligned feed to the C-shape forming heads 3 and 4 by the walking beam transfer conveyor system 5.

B. Walking Beam Transfer Conveyor System 5

The deactuated position from which the walking beam transfer conveyor system begins its cycle is illustrated in full lines in FIG. 3. As shown in such figure, the walking beam conveyor system includes a series of transversely spaced transfer plates or cradles 26 carried by a rectangular beam 27 extending transversely of the line to end positions adjacent the C-shape forming heads 3 and 4 as best shown in FIG. 2.

Such beam 27 is supported by the piston rod 28 of a hydraulic piston-cylinder assembly 29 positioned below the center of the beam. The piston rod 28 of such piston-cylinder assembly extends through a hole 30 in carriage frame 31, which in turn supports and carries the cylinder 29 depending downwardly therefrom. As described in more detail hereinafter, such vertically oriented piston-cylinder assembly 29 selectively elevates and lowers the beam 27 and cradles 26 supported thereby, with such vertical movement being guided at opposite sides of the cylinder 29 by transversely spaced guide rod assemblies indicated generally at 33.

Figure 4:
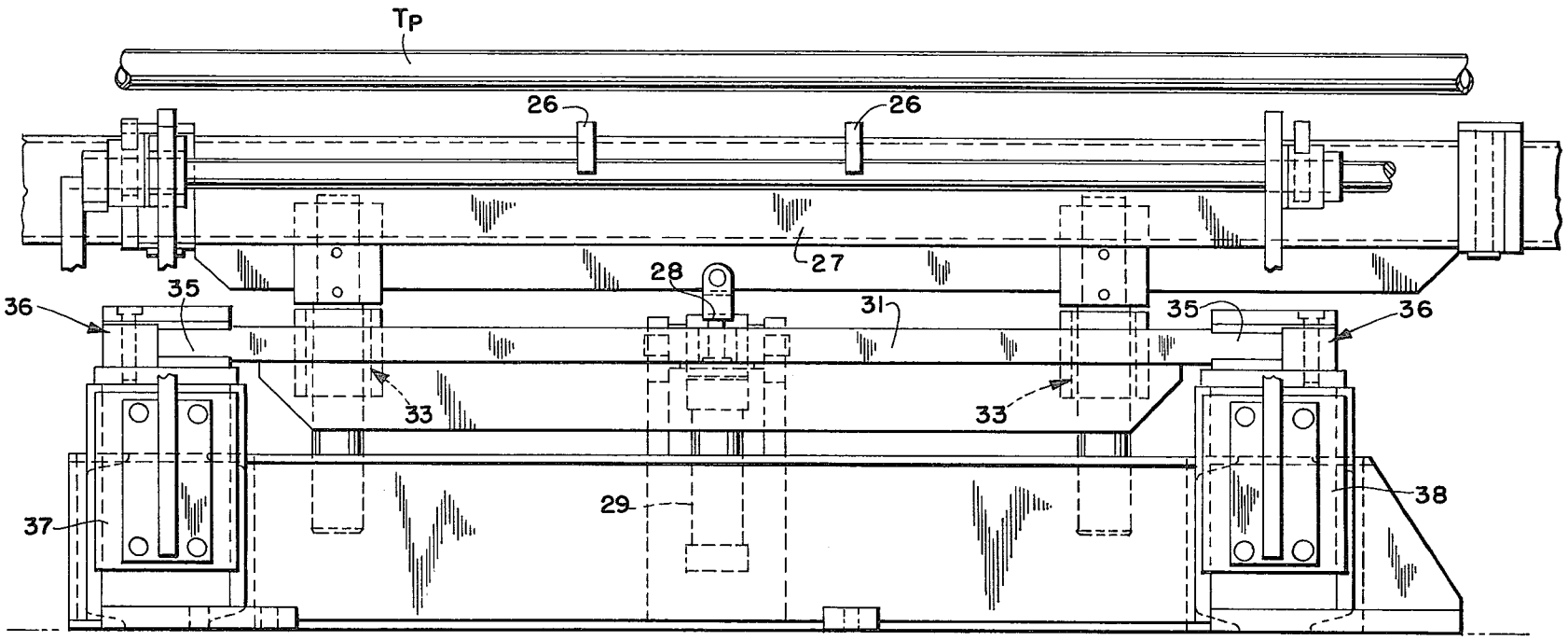
FIG. 4 is a fragmentary elevation taken along line 4—4 of FIG. 3 showing the walking beam transfer conveyor with portions thereof being broken away for clarity of illustration.

As best shown in FIG. 4, the lateral sides 35 of the carriage frame 31 are suitably received in transversely spaced inwardly facing channel shape tracks 36 respectively formed in the top of transversely spaced stanchions 37 and 38. Such transversely spaced channel shaped tracks 36 guide the carriage frame 31 during horizontal reciprocal sliding movement therealong. Such horizontal movement is controlled by a horizontally oriented hydraulic piston-cylinder assembly 40 mounted on a support 41 connected in cantilevered relationship to a channel member 42 extending between and connected to stanchions 37 and 38, as best shown in FIGS. 3 and 4. The piston rod 44 of horizontally oriented piston-cylinder assembly 40 is connected to the carriage frame 31 at 45 selectively to drive the latter in a reciprocal horizontal path.

The walking beam transfer conveyor initially is actuated from its FIG. 3 full line position by cylinder 29 vertically to elevate the beam 27 and support cradles 26, with the correspondingly spaced grooves or notches 47 and 48 on each of such cradles respectively being aligned with and directly below the tube Tp in the ready position against stops 23 and the finished tube $T_f$ in the forming apparatus. Such vertical ascent of the cradles 26 results in the tubes $T_p$ and $T_f$ being stripped from their respective supports and then being supported by the grooves 47 and 48 in cradles 26, as shown in the phantom line position of FIG. 3. The horizontal piston-cylinder assembly is then actuated horizontally to drive the carriage 31 and elevated support cradles 26 with tubes Tp and $T_f$ thereon to the right as viewed in FIG. 3 to the dotted line position 26B in which tube Tp is in the C-shape forming heads 3 and 4 directly above the support clamps therefor and in which formed tube $T_f$ is directly above the exit ramp 6. The vertically oriented piston-cylinder assembly in the phantom line position 29B is then actuated to lower the beam and support cradles carried thereby to the dotted line position 26C in FIG. 3. During such downward movement, the tubes Tp and $T_f$ are respectively deposited on the clamp support members in the heads 3 and 4 and on the downwardly inclined exit ramp 6. The horizontally oriented piston-cylinder assembly 40 is then again actuated to retract for return of the carriage assembly 31 to the full line position illustrated in FIG. 3 to prepare the walking beam transfer conveyor for subsequent initiation of the above-described transfer cycle once the forming operation on the tube Tp just deposited has been completed in the end forming heads.

C. End Forming Heads 3 and 4

The laterally spaced forming heads 3 and 4 have many common structural details and for clarity of understanding, the following description relates to the swaging head 3 with like parts in the dedimpling head 4 being identified by like reference numerals. The swaging head 3 has a base 50 and an inverted L-shape housing 51 connected to and extending upwardly from the top surface 52 of the base to define therewith a C-shape feed opening 53. A stationary lower support clamp member 55 is fixedly connected by removable fasteners 56 to the top surface of a spacer 58 extending upwardly from the top surface 52 of base 50 into the C-shape feed opening 53. The top surface of lower clamp member 55 is centrally provided with a semi-cylindrical groove 59 to receive the tube deposited thereon during the descent of the walking beam transfer conveyor as described above. Such groove 59 may be coated with a resilient material, if desired, to avoid marring the exterior surface of the tube.

The horizontally extending portion of the inverted L-shape housing 51 is directly above the stationary lower clamp member 55 and has a clamp compartment 61 therein selectively receiving a portion of a vertically movable upper clamp member assembly, indicated generally at 62. Such assembly 62 includes a vertically oriented piston-cylinder assembly 64 mounted to and extending above the top wall of the inverted L-shape housing 51. The piston rod 66 of such piston-cylinder assembly is connected to the top of a slide member 68 selectively received in and guided by clamp compartment 61. Such slide member 68 has an upper, vertically movable clamp member 70 secured therebelow by removable fasteners 71, with such upper clamp member 70 having a coated or uncoated semi-cylindrical recess 72 in the bottom surface thereof directly above and aligned with recess 59 in the stationary lower clamp member 55. When the piston-cylinder assembly 64 is fully retracted, the slide member 68 and verticaly movable upper clamp member 70 are totally received within clamp compartment 61 of the inverted L-shape housing 51 fully to open the area above the stationary clamp member 55 in the C-shape feed opening 53 for tube feed and removal by the walking beam transfer conveyor 5 as described above. When the piston-cylinder assembly 64 is actuated, the piston rod 66 lowers the slide member 68 and upper clamp member 70 until the latter achieves a position in which the semi-cylindrical transversely extending groove therein is in surface engagement with a tube supported on the stationary lower clamp member 55. Such opposed surface engagement by the grooves 59 and 72 in the lower and upper clamp members, respectively, tightly engages and positively grips the tube substantially about its entire periphery to permit the end forming operations accurately to be performed on the same without transverse shifting of the tube. When the end forming operations have been completed, the vertically movable clamp member is elevated to its retracted position within the clamp compartment 61 of inverted L-shape housing 51 to re-initiate the tube feed and removal by the walking beam transfer conveyor 5.

As mentioned above, the end forming operations performed while the tube is clamped consist of swaging at one end and dedimpling at the other as illustrated and described hereinafter. However, if dictated by the order being processed, the end forming steps may be bypassed altogether by dummying the tube through the heads 3 and 4.

Figure 5:
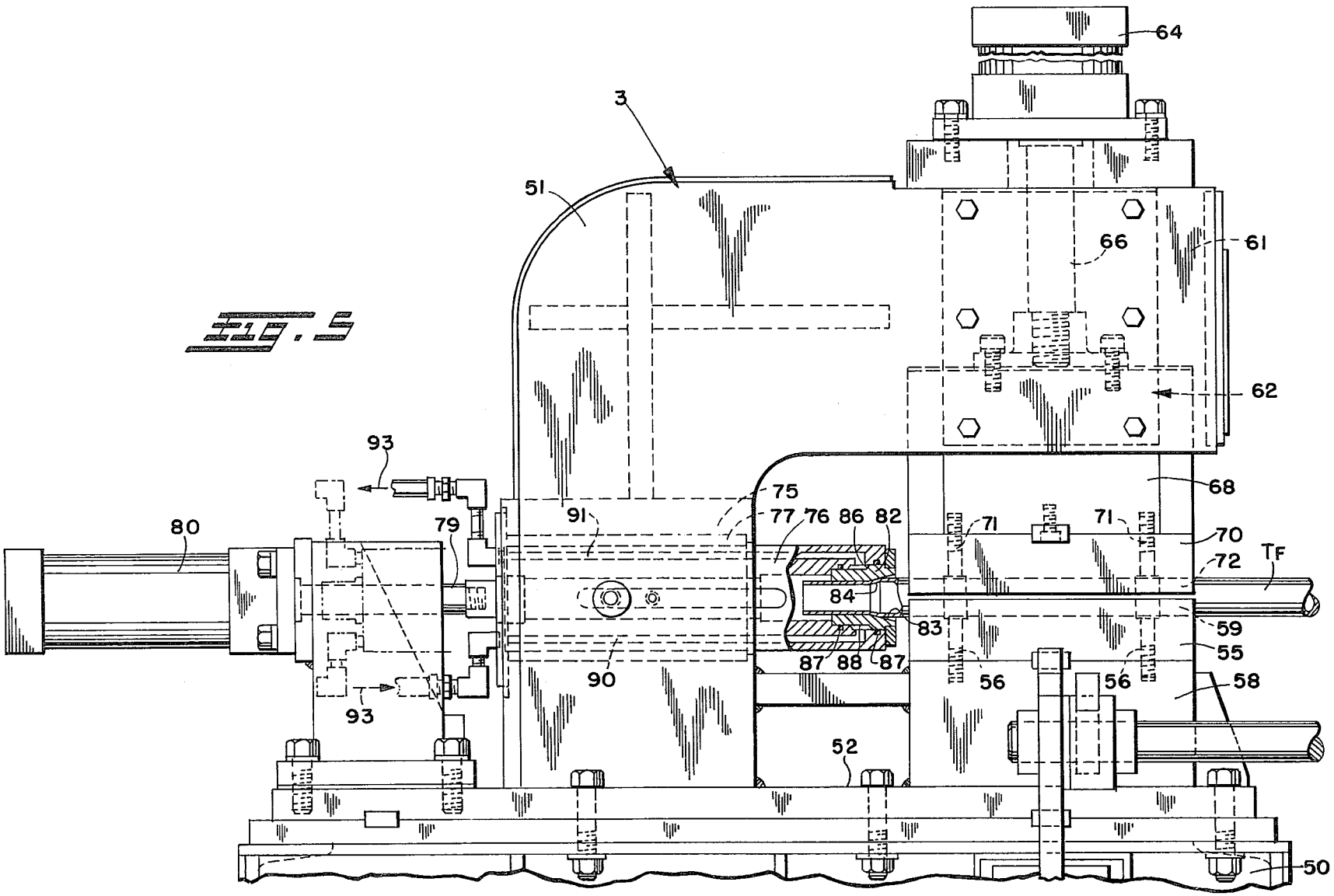
Figure 5:
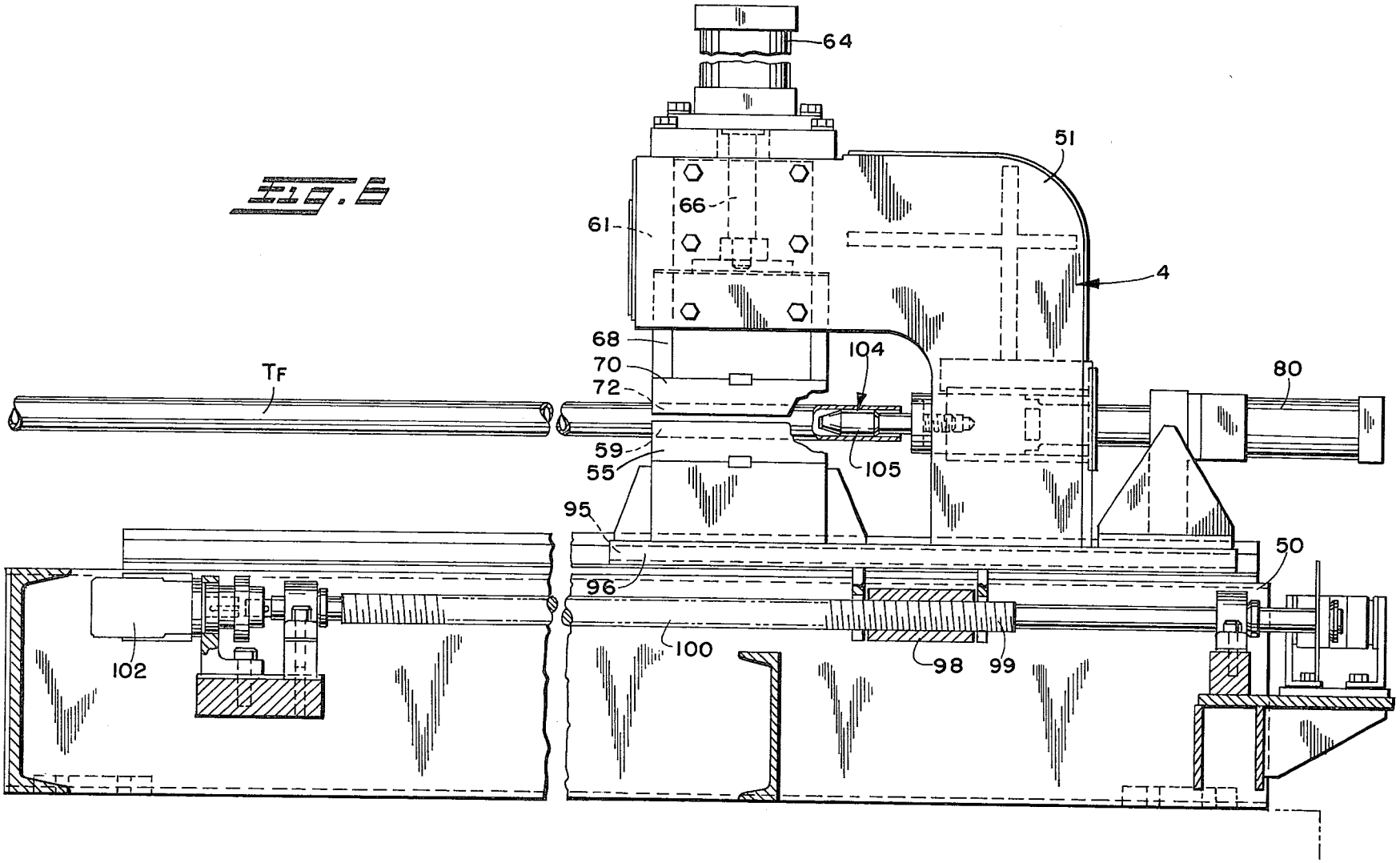

Referring initially to the swaging head, the vertically extending portion of inverted L-shape housing 51 defines a swaging or forming compartment 75 therein having a horizontally extending ram 76 slidably mounted therein, with such sliding movement being guided by a cylindrical bearing 77. The outer or left end of the sliding ram 76, as viewed in FIG. 5, is connected to the piston rod 79 of horizontally oriented, bi-directional hydraulic piston-cylinder assembly 80, which is supported by a mounting block extending above and connected to the top surface of base 50. In such mounted position, the center line of the piston-cylinder assembly 80 is common to the center line of the clamped tube T operationally to result in the expansion stroke of such cylinder horizontally advancing the ram 76 and swaging die 82 removably carried on the lead face thereof into operative engagement with the tube end.

Such swaging die 82, which is preferably made from titanium carbide sold by Chromalloy under the trademark FERRO TIC, includes a conventionally shaped tapered inner forming bore 83 having a contour configured relative to the diameter of the tube being formed to result in such tube having the swaged reduced end 84 formed thereby when the die is advanced into engagement therewith. The outer surface of the swaging die 82 is annularly radially inwardly stepped at 86 to define a reduced diameter annular portion. The outer circumferential portions of die 82 are annularly sealed at axially spaced locations 87 to the inner diameter of the bore through ram 76, with such seals 87 being on opposite sides of the reduced diameter portion of die 82 resulting in such portion cooperating with ram 76 to form an annular water chamber 88. Such water chamber 88 communicates with both a lower water feed line 90 and an upper water withdrawal line 91 extending through the ram 76. Therefore, during operation, water can continually circulate through inlet line 90, chamber 88 and outlet line 91 as indicated by arrows 93, with such water passing around the die to cool the same during operation. The use of the titanium carbide material for the swaging die and the water cooling of the same are believed to improve the life of the swaging dies and the dependability of the swaging operation and the products formed thereby, particularly when exteriorly coated galvanized tubes are being formed.

When the swaging operation has been completed, cylinder 80 is actuated to retract the ram 76 and remove the swaging die 83 from the tube end. When fully retracted, the ram and swaging die are substantially completely enclosed in the swaging compartment 75 on inverted L-shape housing 51, thereby fully to open the C-shape feed aperture 53 to provide adequate clearance for tube feed and withdrawal.

Turning now to the dedimpling operation, the C-shape head 4 at the other end of the galvanized tube being formed can be reciprocally slidably driven transversely along its base 50 selectively to vary the spacing between the two C-shape ends 3 and 4. Such variation in head spacing permits various lengths of tube to be accurately formed by the heads always being positioned at a predetermined distance from each end of the tube before forming irrespective of the length thereof. For example, the C-shape dedimpling head 4 of the present invention may have a 6 ft. transverse travel to permit the end forming apparatus to handle tubes of lengths from 18 to 24 feet on the process line, although other magnitudes of travel and tube length can be selected according to the end use of the product being formed.

To obtain this travel, the dedimpling C-shape head 4 is mounted on an adjustment frame 95 slidably received in transversely extending and longitudinally spaced tracks 96 on base 50. Such adjustment frame 95 has an elongated cylindrical nut 98 attached thereto and depending downwardly therefrom, with the nut being internally threaded to mesh with the threads 99 on drive screw 100. Such drive screw 100 is suitably rotatably mounted at its ends to the fixed base 50, and a bi-directional motor 102 is coupled to the end of such drive screw selectively to rotate the same in either angular direction, as necessary. Rotation of such screw 100 will axially drive the cylindrical nut 98 in mesh therewith and such axial movement will in turn correspondingly axially move the entire adjustment frame 95 and dedimpling head 4. Rotation of drive screw 100 in one direction is operative slidingly to move the head 4 to the right as viewed in FIG. 6 with the maximum extent of such travel being indicated in full lines in FIG. 1, while rotation of drive screw 100 in the opposite direction is operative slidingly to move the head 4 to the left with the maximum extent of such travel being indicated in phantom lines 4' in FIG. 1. It is preferred that the variably positioned head be used for the dedimpling operation since larger forces are encountered at the swaging end, making a fixed base preferable for such swaging operation.

As shown in FIG. 6, the dedimpling die 104 is directly removably connected to the inner end of the ram 76 on piston-cylinder assembly 80. When such cylinder 80 is actuated for expansion, the ram 76 is advanced to direct the dedimpling die 104 into the end of the clamped tube T as shown in FIG. 6. Such dedimpling die is selected to have an outer diameter at its cylindrical portion 105 which substantially equals the inner diameter of the tube. Thus the movement of such dedimpling die into the end of the tube removes any dimples or other inwardly projecting imperfections to result in a uniformly formed tube end. The cylinder 80 is then reversely cycled to retract the ram 76 and dedimpling die 104, thereby to withdraw the same from the end of the tube to complete the dedimpling operation. The cylinder 64 is then actuated to elevate the vertically movable upper clamping member 70 to permit the formed tube $T_f$ to be removed.

D. Operation of the End Forming Apparatus

Prior to initiating operation of the end forming apparatus, the operator positions the adjustable head 4 in the proper location relative to the fixed head 3 to handle the tube lengths to be processed. The operator also makes sure that the lower and upper clamp members 55 and 70 and the swaging and dedimpling dies 82 and 104 on the two heads 3 and 4 are properly sized for the diameter of the tube lengths to be processed, and if not, such elements are replaced by properly sized elements. Similarly, the stops 9 on the tube delivery system have to be adjusted to the diameter of the tube to be processed to position the trailing edge of the lead tube directly above projections 13 on spaced separator arms 14 to insure that only one tube at a time is stripped by such arms 14 for advancement to the tube pick up station for the walking beam transfer conveyor. With such initial operational steps completed, the end forming apparatus is actuated to begin the operational process thereof, with the description of such process being with the upper clamp members 70 in their elevated, retracted positions, with the newly formed tube $T_f$ still resting on the lower clamp members 55, with the walking beam transfer conveyor 7 in the full line position of FIG. 3, and with an unfinished tube Tp at the pick-up position against stops 23.

The vertically oriented piston-cylinder assembly 29 of the walking beam transfer conveyor is then actuated to elevate the beam 27 and the transversely spaced cradles 26 thereon as indicated by arrow 110. During such vertical advancement, the finished tube $T_f$ and unfinished tube Tp are respectively picked up by the transfer cradles 26 and carried by the aligned longitudinally spaced V-shape notches 47 and 48 in such transfer cradles. To insure tube pick up and support, magnets (not shown) may be positioned adjacent the notches 47 selectively but positively to secure the tubes to the cradle during transfer. When the beam and transfer cradles are completely elevated as shown by the phantom lines 26A in FIG. 3, the horizontally oriented piston-cylinder assembly 40 is actuated to advance the carriage 31 in the direction of arrow 112 to the phantom line position 31B in FIG. 3, with the beam and transfer plates being similarly advanced in their elevated position by such carriage movement to the location shown by the phantom lines 26B in FIG. 3. Such horizontal movement of the elevated tubes Tp and $T_f$ carried by the transfer cradles 26 is permitted by the vertical clearance in the C-shape feed apertures 53 of heads 3 and 4, which clearance is provided when the upper clamp members 70 are in their elevated, retracted position within the clamp compartments 61 of the C-shape heads.

With the transfer cradles in the elevated advanced position, the ends of the unfinished tube Tp are directly above and in vertical alignment with the grooves 59 in the stationary lower clamp members 55 in C-shape heads 3 and 4, and the finished tube $T_f$ is directly above and aligned with the downwardly inclined run-off ramps 6. From such position, the vertical cylinder in the phantom line position 29B is actuated to lower the beam and transfer cradles as shown by the arrow 114. Such descent of the beam and transfer plates results in the tube Tp being deposited upon the grooves 59 in the lower clamp members 55 of the two spaced heads and in the tube $T_f$ being deposited upon the upper end of the exit ramp. At the completion of the descent cycle shown in phantom lines at 26C in FIG. 3, the cylinder 40 is retracted to return the carriage 31 and thus the beam and transfer cradles carried thereby in the direction of arrow 116 to the full line FIG. 3 position. A conventional chain and gear equalizing system (not shown) may be coupled to the beam 27 to avoid cocking of the same during the four phase cyclical movement just described.

With the ends of the tube Tp now received in the semi-cylindrical grooves 59 in the lower clamp members 55 for support thereby, the two vertically oriented cylinders 64 on top of the two C-shape heads are simultaneously energized downwardly to drive the slide member 68 and upper clamp member 70 until the semi-cylindrical grooves 72 on the lower surfaces of the latter come into engagement with the supported tube at both ends thereof. Such engagement provides a positive gripping force at each end of the tube tightly to clamp the same during the end forming operation.

With the tube Tp thus clamped, the horizontally oriented piston-cylinder assemblies 80 on heads 3 and 4 are simultaneously actuated respectively to advance the water cooled swaging die 82 at one end and the dedimpling die 104 at the other end. When such dies are fully advanced, one end of the tube is swaged as shown in FIG. 5 and the other end of the tube has been diametrically sized to eliminate any dimples thereon as shown in FIG. 6. The piston-cylinder assemblies 80 are then simultaneously actuated respectively to withdraw the swaging and dedimpling dies to the retracted position in which such dies are substantially included within the forming compartments 75 of the inverted L-shaped housings 51.

Immediately after the dies 82 and 104 have been withdrawn from the tube ends, the upper vertical cylinders 64 are actuated to elevate the upper, movable clamping members 70 into the retracted position within clamping compartments 61 of heads 3 and 4. Such movement completes the end forming cycle and returns the forming heads to the positions characterized as the starting point for the operation of the cycle hereinabove.

During the forming operation, the tube delivery and alignment assembly 2 is operating to advance a tube to the pick-up position. More specifically, the separator arms 14 are vertically elevated as shown by the arrow 118 in FIG. 3 to remove the leading tube from the plurality of tubes in side to side engaging position on the downwardly inclined input ramps 8. The vertical movement of such separator results in the triangular projection 13 on the back edge thereof moving between the lead and second tube to remove the lead tube while retaining the second tube in position. The lead tube is then elevated above the stops 9 as shown in phantom lines in FIG. 3, which results in such tube being free to roll down the elevated downwardly inclined ramp extensions 21 until engagement with end stops 23. The leading tube in such position against end stops 23 is then transversely aligned by cylinder 24 on head 4 being actuated to engage one end of the tube aligned therewith to drive the same lengthwise until the other end thereof engages gage plate 25 on head 3. The lead tube is then in position Tp for pickup by the walking beam transfer conveyor 5.

During the end alignment of the lead tube Tp, the separator arms 14 are downwardly cycled to permit the plurality of tubes in side to side engagement on input ramps 8 to roll forwardly until the lead tube is in engagement with stops 9. Such tubes are then properly positioned for the subsequent separation cycle just described when the tube now in the pick-up position has been removed.

The above described operation of the various components of the feed and forming apparatus permits tubes rapidly to be fed to and removed from the end forming apparatus. Such structure may handle, for example, fifteen to eighteen lengths of 18 to 24 foot pipe per minute. Such feed and forming rate permits the swaging and dedimpling operation substantially to be performed in line with a continuous tube forming and galvanizing operation which normally runs at a rate of from 50 to 300 feet per minute. Although tubes have been described throughout as the exemplary work piece, it will be appreciated that the work piece could take other cross sectional forms and still be used with the forming apparatus of the present invention.

I claim:

1. An apparatus for forming work pieces comprising a first generally C-shape head defining a feed opening therein, a first clamp member fixedly mounted on said head and extending into the feed opening, a second movable clamp member mounted on said head and extending into said opening generally in alignment with but in an opposite direction from said first clamp member, said second movable clamp member selectively reciprocating between open and closed positions, means automatically to convey a work piece to the feed opening of said first head for support by said first clamp member when said second movable clamp member is in open position while simultaneously removing a work piece from said first clamp member, and forming means reciprocally movable into and out of said feed opening generally perpendicularly to the first and second clamp members, said forming member moving into said feed opening and engaging and forming the work piece when the second clamp member is in the closed position engaging the work piece, thereby to cooperate with said first clamp member tightly to grip and hold the work piece in position during forming.

2. The apparatus set forth in claim 1 further comprising a second C-shape head defining a feed opening therein in alignment with said first head and with the work piece feed to result in respective portions of the work piece being simultaneously received in the feed openings of said first and second C-shaped heads.

3. The apparatus set forth in claim 2 wherein said second C-shape head has first and second clamp members similar to and simultaneously operating with the first and second clamp members on said first C-shape head.

4. The apparatus set forth in claim 2 further comprising means to vary the relative spacing between the first and second C-shape heads to receive work pieces of correspondingly varying sizes.

5. The apparatus set forth in claim 4 wherein the means to vary the relative spacing includes means selectively to shift one of the C-shape heads toward and away from the other C-shape head which is fixed, one of the heads carrying an alignment cylinder operative upon actuation to engage one end of a work piece awaiting feed to advance the same into engagement at the other end with a gage plate carried by the other head, thereby properly to align the work piece for feed thereof to the heads.

6. The apparatus of claim 1 wherein the work pieces are elongated hollow tubes and the forming means is a swager operative to shape the ends of said tubes.

7. The apparatus of claim 6 wherein said means to convey further includes walking beam means having two recesses thereon simultaneously to support one swaged tube and one unswaged tube.

8. The apparatus of claim 7 wherein said means to convey includes means to separate one unswaged tube from a plurality of unswaged tubes and to position said unswaged tube for pick-up by said walking beam.

9. The apparatus of claim 8 wherein said walking beam includes means to cycle the same through four stages of movement, the first stage being vertically upwardly to remove and support a swaged tube from said first clamp member and an unswaged tube from said means to separate, the second stage being horizontally to position the previously elevated swaged tube above an outlet conveyor and the unswaged tube above the first clamp member, the third stage being vertically downwardly to deposit the swaged tube on an outlet ramp and the unswaged tube on the first clamp member, and the fourth stage being horizontally to return the walking beam to a position to repeat the cycle.

10. The apparatus of claim 1 wherein said forming member is a swager and said work piece is a hollow tube, said swager having a die which is water cooled and made from titanium carbide.

11. The apparatus of claim 1 wherein the work piece is an elongated hollow tube and the forming means includes a die operative to enter the end of the hollow tube to remove any dimples thereon and to size the same.

12. The apparatus set forth in claim 8 wherein said means to separate includes adjustable stop means selectively set to locate the lead tube above vertically movable separator means operative to remove such lead tube from said plurality of tubes for subsequent pick up by said walking beam.

* * * * *